US007604074B2

(12) United States Patent
Eyre et al.

(10) Patent No.: US 7,604,074 B2
(45) Date of Patent: Oct. 20, 2009

(54) CUTTING ELEMENTS AND BITS INCORPORATING THE SAME

(75) Inventors: Ronald K. Eyre, Orem, UT (US); Yabei Gu, Painted Post, NY (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 11/811,671

(22) Filed: Jun. 11, 2007

(65) Prior Publication Data

US 2008/0302578 A1 Dec. 11, 2008

(51) Int. Cl.
*E21B 10/55* (2006.01)

(52) U.S. Cl. ..... 175/432

(58) Field of Classification Search ..... 175/432
See application file for complete search history.

(56) References Cited

U.S. PATENT DOCUMENTS

| | | | | |
|---|---|---|---|---|
| 5,351,772 | A | 10/1994 | Smith | |
| 5,469,927 | A | 11/1995 | Griffin | |
| 5,486,137 | A | 1/1996 | Flood et al. | |
| 5,492,188 | A | 2/1996 | Smith et al. | |
| 5,564,511 | A * | 10/1996 | Frushour | 175/431 |
| 5,611,649 | A * | 3/1997 | Matthias | 407/118 |
| 5,662,720 | A * | 9/1997 | O'Tighearnaigh | 51/295 |
| 5,709,279 | A * | 1/1998 | Dennis | 175/430 |
| 5,871,060 | A | 2/1999 | Jensen et al. | |
| 5,906,246 | A | 5/1999 | Mensa-Wilmot et al. | |
| 5,928,071 | A | 7/1999 | Devlin | |
| 5,957,228 | A * | 9/1999 | Yorston et al. | 175/430 |
| 6,026,919 | A | 2/2000 | Thigpen et al. | |
| 6,041,875 | A | 3/2000 | Rai et al. | |
| 6,077,591 | A * | 6/2000 | Griffin | 428/172 |
| 6,149,695 | A | 11/2000 | Adia et al. | |
| 6,227,319 | B1 | 5/2001 | Radford | |
| 6,315,067 | B1 | 11/2001 | Fielder | |
| 6,315,652 | B1 | 11/2001 | Snyder et al. | |
| 6,330,924 | B1 | 12/2001 | Hall | |
| 6,488,106 | B1 | 12/2002 | Dourfaye | |
| 6,571,891 | B1 | 6/2003 | Smith et al. | |
| 6,739,417 | B2 | 5/2004 | Smith et al. | |
| 6,962,218 | B2 | 11/2005 | Eyre | |
| 2004/0009376 | A1 * | 1/2004 | Wan et al. | 428/698 |
| 2004/0245025 | A1 * | 12/2004 | Eyre | 175/432 |
| 2006/0021802 | A1 | 2/2006 | Skeem et al. | |
| 2006/0065447 | A1 | 3/2006 | Svendsen et al. | |
| 2007/0062737 | A1 | 3/2007 | Hall et al. | |

FOREIGN PATENT DOCUMENTS

| | | |
|---|---|---|
| EP | 0 582 484 A1 | 2/1994 |

* cited by examiner

*Primary Examiner*—Hoang Dang
(74) *Attorney, Agent, or Firm*—Christie, Parker & Hale, LLP.

(57) ABSTRACT

A cutting element is provided including a substrate having a periphery and an interface surface. An ultra hard material layer is formed over the substrate and interfaces with the interface surface. The interface surface also includes a plurality of spaced apart projections formed inwardly and spaced apart from the periphery and arranged around an annular path, such that each projection includes a convex upper surface defining the projection as viewed in plan view. Each upper surface continuously and smoothly curves in the same direction when viewed along a plane through a diameter of the substrate. Bits incorporating such cutting elements are also provided.

26 Claims, 7 Drawing Sheets

CUTTING ELEMENTS AND BITS INCORPORATING THE SAME

BACKGROUND OF THE INVENTION

Cutting elements, as for example cutting elements used in rock bits or other cutting tools, typically have a body (i.e., a substrate), which has an interface face. An ultra hard material layer is bonded to the interface surface of the body by a sintering process to form a cutting layer, i.e., the layer of the cutting element that is used for cutting. The substrate is generally made from tungsten carbide-cobalt (sometimes referred to simply as "cemented tungsten carbide," "tungsten carbide" "or carbide" ). The ultra hard material layer is a polycrystalline ultra hard material, such as polycrystalline diamond ("PCD"), polycrystalline cubic boron nitride ("PCBN") or thermally stable product ("TSP") material such as thermally stable polycrystalline diamond.

Cemented tungsten carbide is formed by carbide particles being dispensed in a cobalt matrix, i.e., tungsten carbide particles are cemented together with cobalt. To form the substrate, tungsten carbide particles and cobalt are mixed together and then heated to solidify. To form a cutting element having an ultra hard material layer such as a PCD or PCBN ultra hard material layer, diamond or cubic boron nitride ("CBN") crystals are placed adjacent the cemented tungsten carbide body in a refractory metal enclosure (e.g., a niobium enclosure) and subjected to a high temperature and high pressures so that inter-crystalline bonding between the diamond or CBN crystals occurs forming a polycrystalline ultra hard material diamond or CBN layer. Generally, a catalyst or binder material is added to the diamond or CBN particles to assist in inter-crystalline bonding. The process of heating under high pressure is known as sintering. Metals such as cobalt, iron, nickel, manganese and alike and alloys of these metals have been used as a catalyst matrix material for the diamond or CBN.

The cemented tungsten carbide may be formed by mixing tungsten carbide particles with cobalt and then heating to form the substrate. In some instances, the substrate may be fully cured. In other instances, the substrate may be not fully cured, i.e., it may be green. In such case, the substrate may fully cure during the sintering process. In other embodiments, the substrate maybe in powder form and may solidify during the sintering process used to sinter the ultra hard material layer.

TSP is typically formed by "leaching" the cobalt from the diamond lattice structure of polycrystalline diamond. This type of TSP material is sometimes referred to as a "thermally enhanced" material. When formed, polycrystalline diamond comprises individual diamond crystals that are interconnected defining a lattice structure. Cobalt particles are often found within interstitial spaces in the diamond lattice structure. Cobalt has a significantly different coefficient of thermal expansion as compared to diamond, and as such, upon heating of the polycrystalline diamond, the cobalt expands, causing cracking to form in the lattice structure, resulting in the deterioration of the polycrystalline diamond layer. By removing, i.e., by leaching, the cobalt from the diamond lattice structure, the polycrystalline diamond layer becomes more heat resistant. In another exemplary embodiment, TSP material is formed by forming polycrystalline diamond with a thermally compatible silicon carbide binder instead of cobalt. "TSP" as used herein refers to either of the aforementioned types of TSP materials.

Prior art interface surfaces on substrates have been formed having a plurality of projecting spaced apart concentric annular bands. Tensile stress regions are formed on the upper surfaces of the bands, whereas compressive stress regions are formed on the valleys between such bands. Consequently, when a crack begins to grow it may grow along the entire annular upper surface of the annular band where it is exposed to compressive stresses, or may grow along the entire annular valley between the projections leading to the early failure of the cutting element. In other prior art cutting element substrate interfaces incorporating spaced apart projections 62, the projections have relative flat upper surfaces or non-planar upper surface due a plurality of shallow depressions as shown in FIG. 9. Applicants believe that such upper surfaces allow a crack to grow and gain momentum and thus become critical.

Common problems that plague cutting elements are chipping, spalling, partial fracturing, cracking and/or exfoliation of the ultra hard material layer. Typically, these problems are caused by cracking on the interface between the ultra hard material layer and the substrate and by the propagation of the crack across the interface surface. These problems result in the early failure of the ultra hard material layer and thus, in a shorter operating life for the cutting element. Accordingly, there is a need for a cutting element having an ultra hard material layer with improved cracking, chipping, fracturing and exfoliating characteristics, and thereby having an enhanced operating life.

SUMMARY OF THE INVENTION

In an exemplary embodiment a cutting element is provided including a substrate having a periphery and an interface surface. An ultra hard material layer is formed over the substrate and interfaces with the interface surface. A plurality of spaced apart projections extend from the interface surface. These spaced apart projections are formed inwardly and spaced apart from the periphery and arranged around an annular path. Each projection includes a convex upper surface defining the projection. Each upper surface continuously and smoothly curves in the same direction increasing and then decreasing in height as viewed in cross-section along a plane through a diameter of the substrate. In a further exemplary embodiment, the interface surface includes a first annular section extending to the periphery, a second section extending radially inward and above the first annular section, and a third annular section between the first annular section and the second section. Each of the plurality of spaced apart projections straddles the first annular section and the second annular section and extends across the first, second and third sections. Furthermore, the second section extends to a height level, such that each of the projections extends above such height level, and such that the projections are spaced apart from the periphery.

In yet a further exemplary embodiment, each of the spaced apart projections is wider over the first section than over the second section. In yet another exemplary embodiment, each of the spaced apart projections when viewed in plan view has a first end having a first width opposite a second end having a second width and a third section between the first and second ends having a third width. The second width is narrower than the first width, and the third width is not greater than, or is smaller than, the second width. In a further exemplary embodiment, each of the spaced apart projections has a width as measured along a plane perpendicular to a central longitudinal axis of the substrate, such that the width decreases as the distance of said plane away from said interface surface increases. In another exemplary embodiment, the interface surface further includes a first annular projection formed radially inward from the spaced apart projections, such that the first annular projection is spaced apart from the spaced apart projections. In yet another exemplary embodiment, the interface surface further includes a second annular projection formed radially inward from the first annular projection, such that the second annular projection is spaced apart from the first annular projection. In yet a further exemplary embodiment, the interface surface further includes a central projection formed radially inward from the first annular projection, such that the central projection is spaced apart from the first annular projection.

In one exemplary embodiment, the first annular projection is polygonal in plan view. In a further exemplary embodiment, each of the spaced apart projection upper surfaces defines a parabola when viewed along the plane through a diameter of the substrate. In another exemplary embodiment, each of the spaced apart projections is trapezoidal in plan view. In yet a further exemplary embodiment, each of the spaced apart projections is widens in a radial direction toward the periphery.

In a further exemplary embodiment, a bit is provided incorporating any of the aforementioned exemplary embodiment cutting elements.

DETAILED DESCRIPTION OF THE INVENTION

In order to improve the cracking, chipping, fracturing and exfoliating characteristics of the cutting elements, Applicants have invented cutting elements having an interface surface between the ultra hard material layer and the substrate having a geometry which improves such characteristics.

In the exemplary embodiments described herein, the interface surface is formed on the substrate which interfaces with the ultra hard material layer. It is to be understood that a negative of such interface surface is formed on the ultra hard material layer interfacing with the substrate.

The term "substrate" as used herein means any substrate over which is formed the ultra hard material layer. For example, a "substrate" as used herein may be a transition layer formed over another substrate. Moreover, the terms "upper," "lower," "upward," and "downward" as used herein are relative terms to denote the relative position between two objects, and not the exact position of such objects. For example, an upper object may be lower than a lower object.

Figure 1:
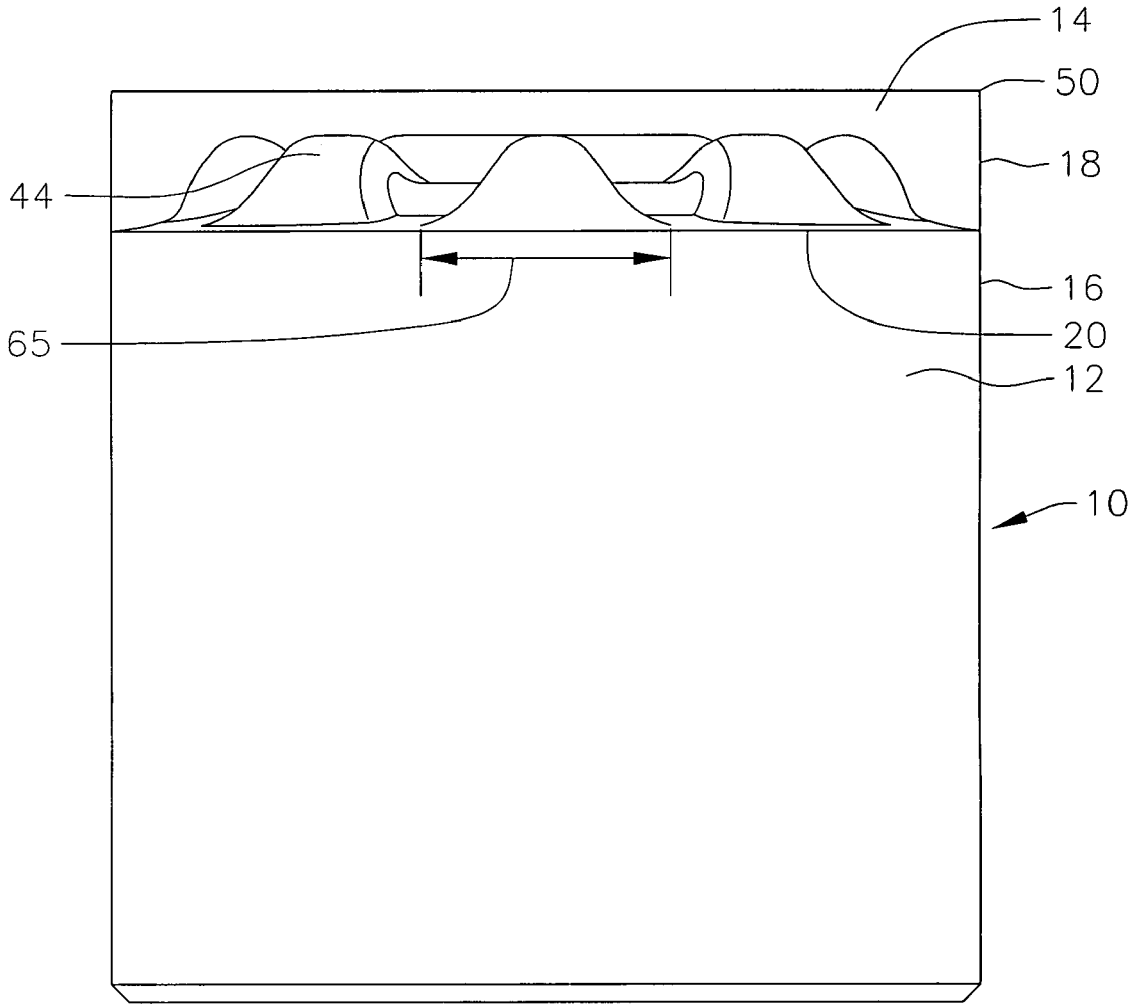
FIG. 1 is an end view of an exemplary embodiment cutting element of the present invention with its cutting layer shown in see-through so as to illustrate the interface between the substrate and the cutting layer.
Figure 2:
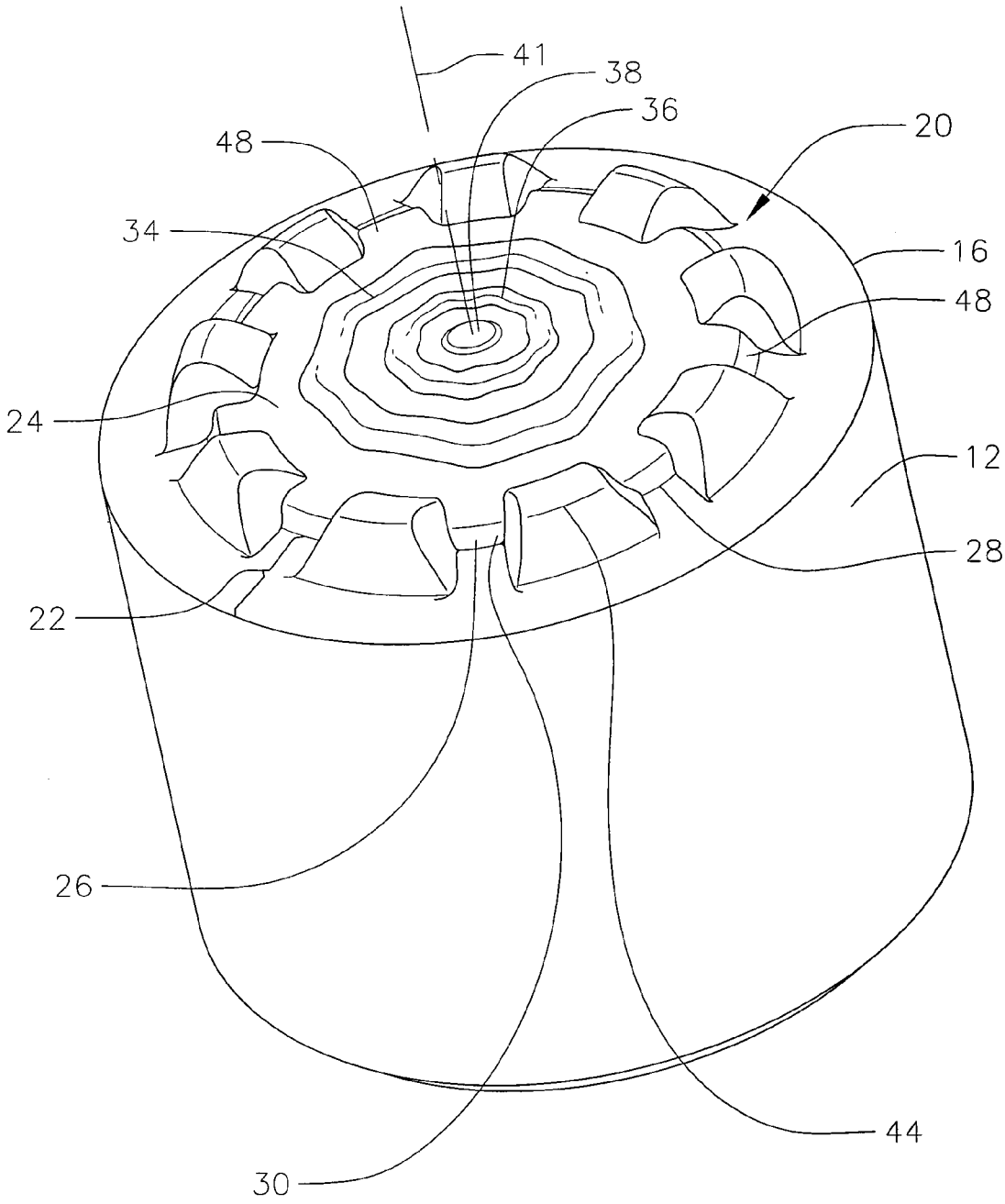
FIG. 2 is a perspective view of the substrate of the cutting element shown in FIG. 1.

In an exemplary embodiment as shown in FIG. 1, a cutting element 10 is provided having a substrate 12 having an interface surface 20 over which is formed an ultra hard material layer 14. The substrate 12, as also shown in FIG. 2 has a periphery 16. The ultra hard material layer also has a periphery 18. In an exemplary embodiment, the interface surface 20 includes a first annular section 22 extending to the periphery 16 of the substrate and a second section 24 extending radially inward from the first section at a level higher than the level of the first section, as shown in FIG. 2. As such, an annular riser 26 is formed between the two sections. In an exemplary embodiment, an interfacing surface 28 between the riser and the first section as well as an interfacing surface 30 between the riser and the second section are rounded when viewed in cross-section (see FIG. 4) so as to reduce stress spiking at such surfaces.

Figure 3:
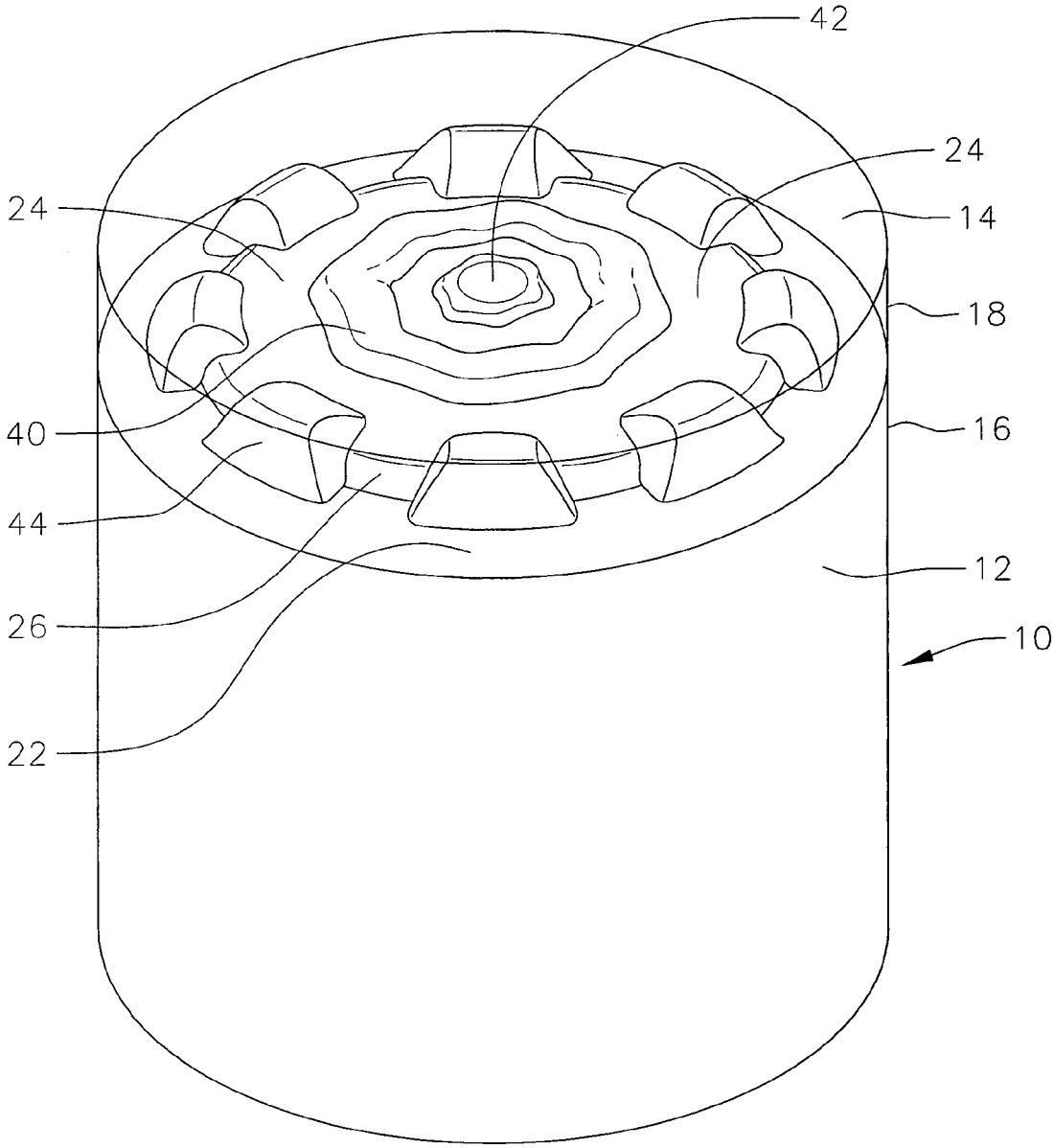
FIG. 3 is a perspective view of another exemplary embodiment cutting element incorporating another exemplary embodiment substrate and having its cutting layer shown in see-through so as to disclose the substrate interface surface.

In a further exemplary embodiment, at least one projecting annular band 34 is formed radially inward extending above the second section 24 and spaced apart from the annular riser 26. In a further exemplary embodiment, a second annular band 36 may be formed radially inward from the first annular band, extending above the second section and spaced apart from the first annular band. The annular bands may be polygonal or circular in plan view. In the exemplary embodiment shown in FIG. 2, both annular bands are polygonal in plan view. In a further exemplary embodiment, a central projection 38 is be formed radially inward from any of the projecting annular bands 34, 36 and spaced apart from such bands, as for example shown in FIG. 2. In another exemplary embodiment as shown in FIG. 3, only a single annular band 40 is formed over the second section 24. With this embodiment, a central projection 42 may be formed surrounded and spaced apart from the annular band 40. In an exemplary embodiment, the central projection extends along the central longitudinal axis 41 of the substrate.

Figure 4:
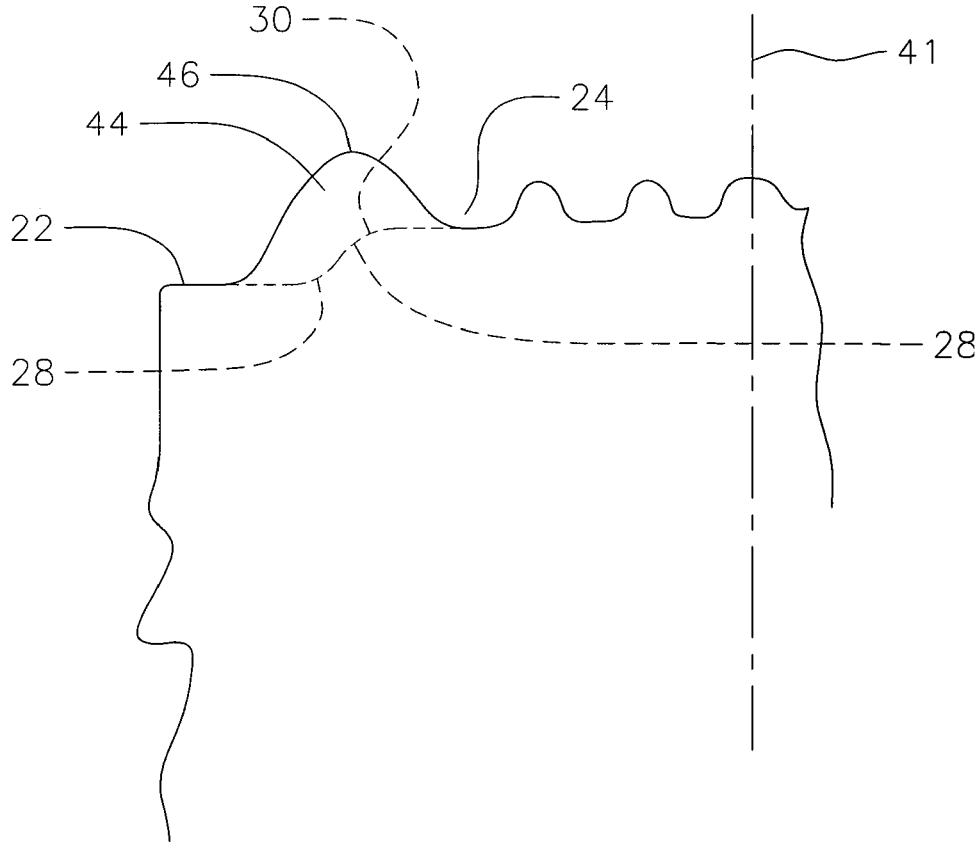
FIG. 4 is a partial cross-sectional view of the substrate shown in FIG. 2 along a plane along a diameter of the substrate.

In an exemplary embodiment, a plurality of spaced apart projections 44 are formed on the interface surface along an annular path straddling the first and second sections 22, 24 and extending across the riser 26, as for example shown in FIGS. 2, 3 and 4. In an exemplary embodiment, these projections are trapezoidal in plan view in that they are wider over the first section 22 than they are over the second section 24. In addition these projections 44 extend to a higher level than the annular projections 34, 36 and the central projection 38. These projections have a rounded outer surface 46 when viewed in cross section taken along a plane along a diameter of the substrate, as for example shown in FIG. 4. In one exemplary embodiment, the projection outer surface extending upward from the first and second sections 22, 24, when viewed in cross-section along a plane along a diameter of the substrate is continuously soothingly curving in the same direction so as to increase and then decrease in height. In an exemplary embodiment, each projection 44 outer surface 46 is parabolic in cross section as viewed along a plane along a diameter of the substrate, i.e., it defines a parabola, as for example shown in FIG. 4.

Figure 5A:
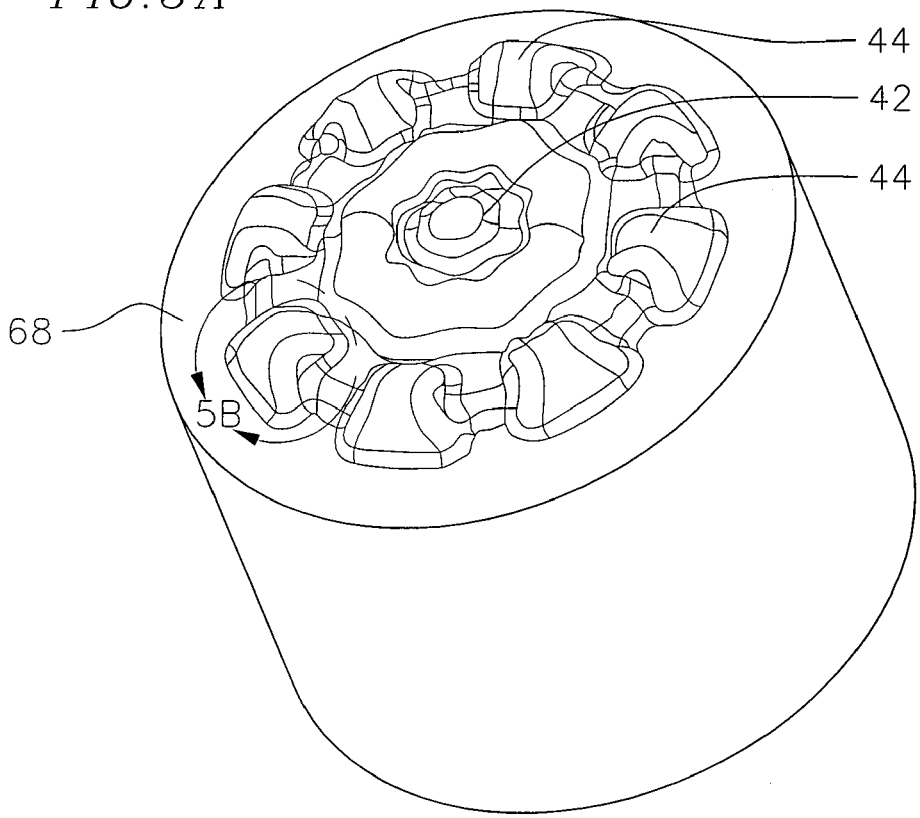
FIG. 5A is a perspective view of another exemplary embodiment cutting element substrate having another exemplary embodiment interface surface.
Figure 5B:
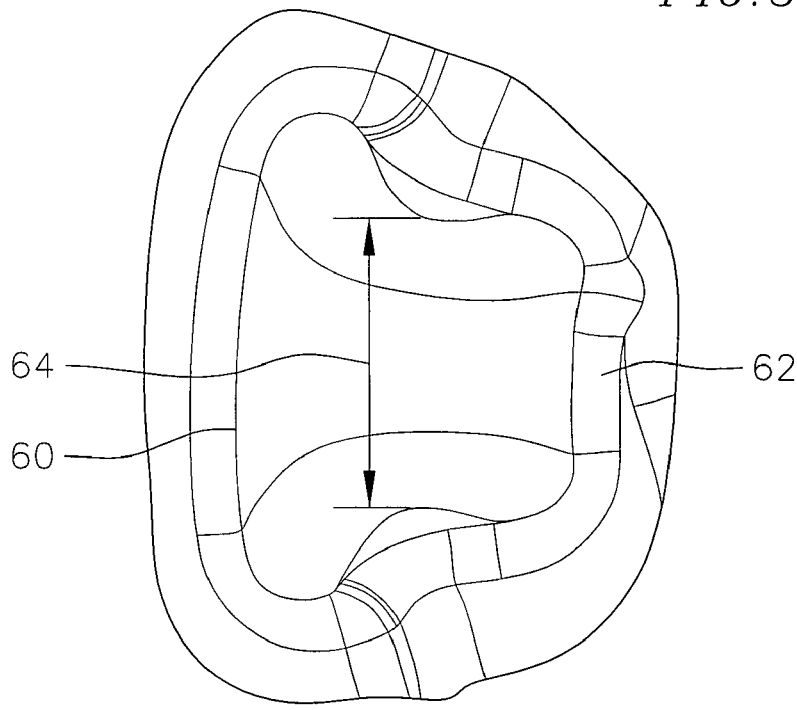
FIG. 5B is a plan view of an exemplary embodiment projection incorporated in the interface surface of the substrate shown in FIG. 5A.

In another exemplary embodiment shown in FIGS. 5A and 5B, the generally trapezoidal projections 44 have a decrease in width when viewed in plan view in that they have a first end 60 having a width that is wider than the width of its opposite second end 62 so as to define the generally trapezoidal shape and a width 64 between the first end and second end is not greater than, or that it is smaller than, the width of the second end 62. In a further exemplary embodiment, the width 65 of the projection 44 decreases in an upward direction away from the interface surface as for example shown in FIG. 1.

By using spaced apart projections having continuously curving outer surfaces in cross-section and arranged around the interface surface as shown in FIGS. 2, 3 and 4, Applicants have discovered that the tensile stress regions which are defined on the upper surfaces of the projections 44 and the compressive stress regions which are defined on the spaces 48 between adjacent projections 44 are balanced during operation of the cutting element, i.e. when the cutting element is cutting. In this regard, if a crack were to form along the interface surface 20, which may grow under either the tensile or compressive stresses during operation, such crack growth will stop once the crack expands to an adjacent section which will have the opposite type of stress. For example, if a crack grows along one of the tensile region on the outer surface 46 of the projections 44, the crack growth will be arrested once the crack grows to a compressive stress region 48 which is formed between adjacent projections. Similarly, any crack growing radially inward should be arrested when reaching any of the annular projections. Furthermore, Applicants have discovered that the annular riser 26 defined between the first and second sections provides for a hoop stress that may be also beneficial in arresting crack growth.

Figure 6:
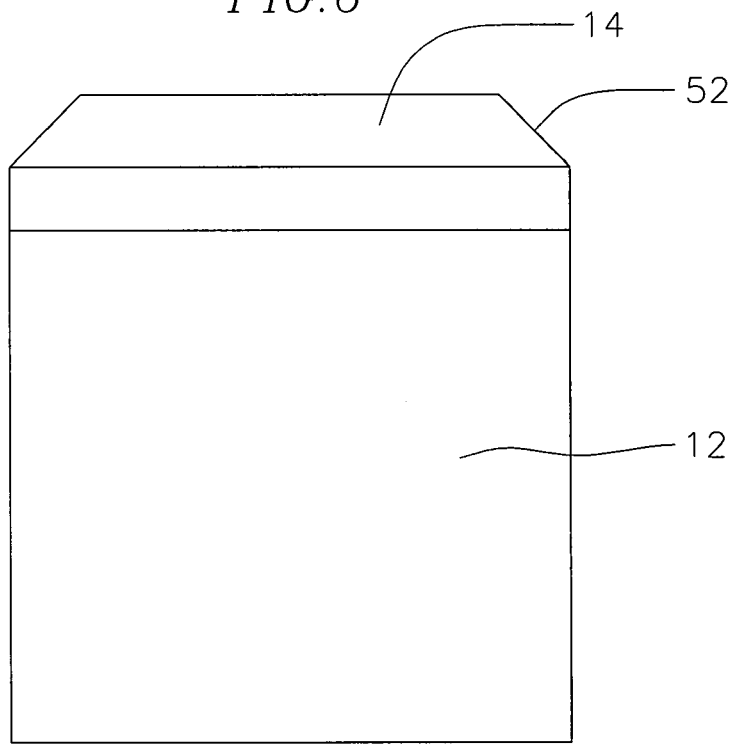
FIG. 6 is an end view of an exemplary embodiment cutting element of the present invention.
Figure 7:
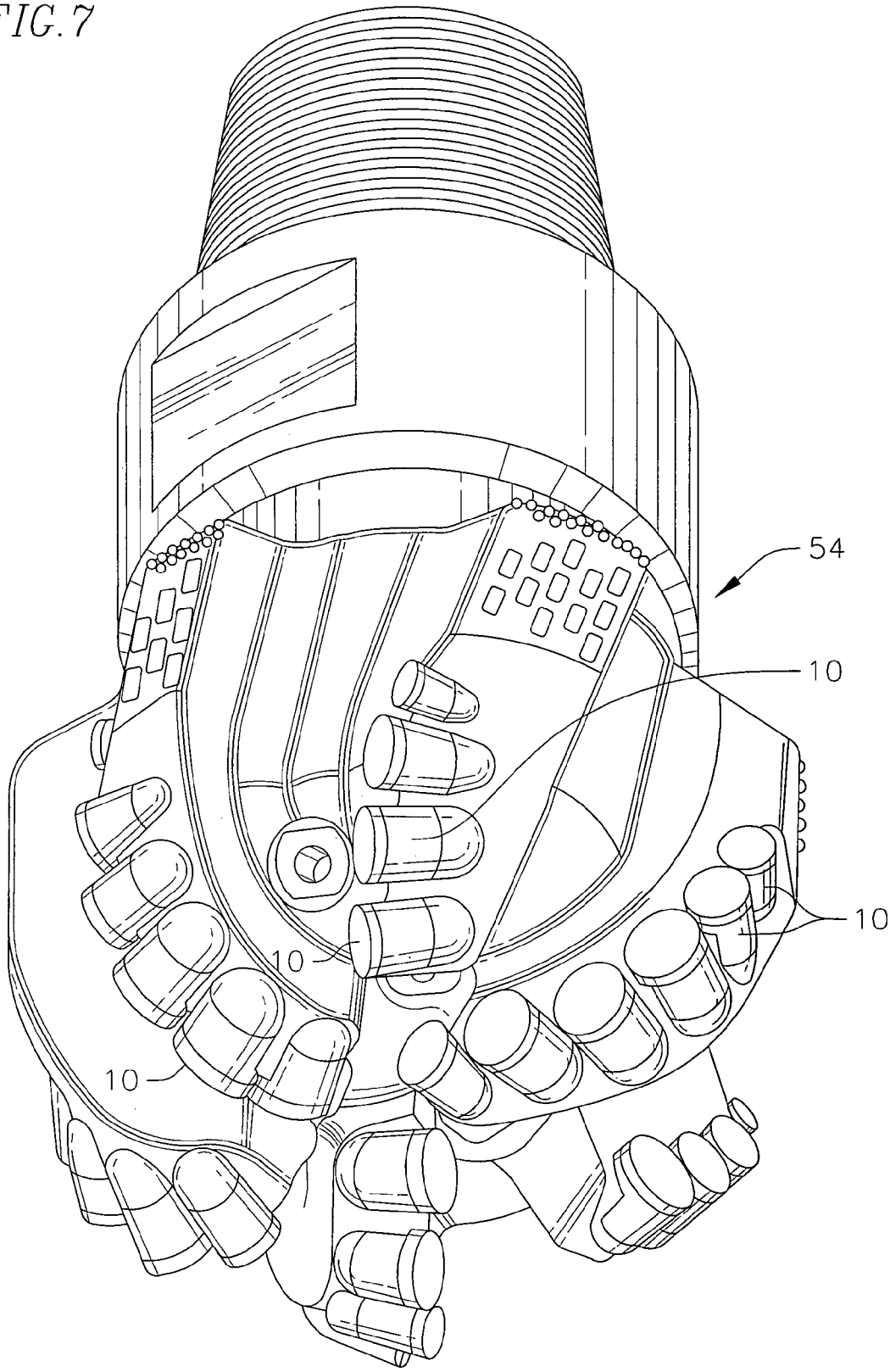
FIG. 7 is a perspective view of a bit body incorporating the cutting elements of the present invention.

In another exemplary embodiment, the interface surface may be formed without the second section 24. In other words, the spaced apart projections 44 and any of the optional annular bands 34, 36 and central projection 38 may all extend from a single surface which may be planar or non-planar and/or non-uniform. Any of the aforementioned exemplary embodiment cutting elements may have sharp cutting edges 50 or beveled cutting edges 52, as for example shown in FIGS. 1 and 6 and may be mounted on a bit body such as bit body 54 shown in FIG. 7.

Figure 8:
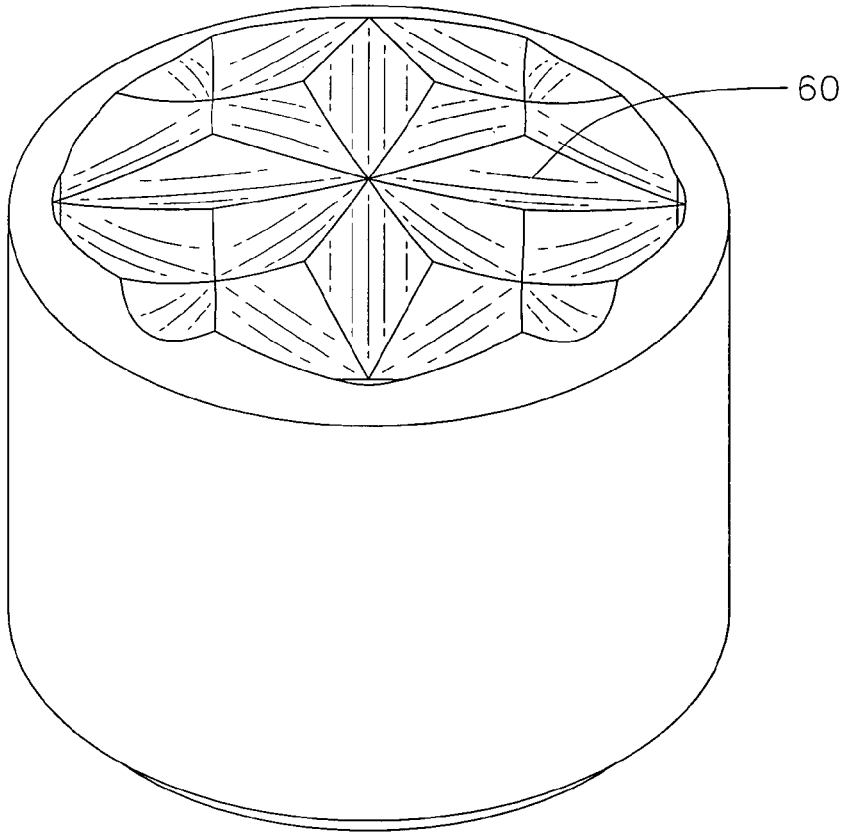
FIG. 8 PRIOR ART
FIGS. 8 and 9 are perspective views of prior art cutting element substrates.
Figure 9:
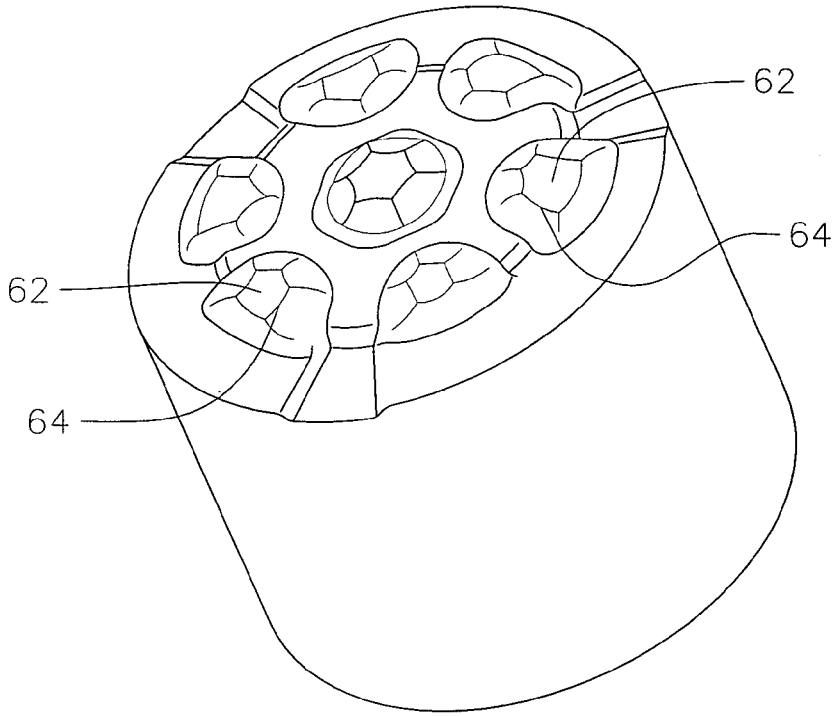
FIG. 9 PRIOR ART

Applicant conducted comparative impact tests using cutting elements incorporating two prior art substrate interfaces and the inventive cutting elements incorporating the inventive interface. The first prior art interface design included a plurality of shallow depressions 60 formed across the entire interface as shown in FIG. 8. A second prior art interface design included a plurality of spaced apart projections 62 defined along an annular path having a relatively horizontal upper surface with a plurality of shallow depressions 64 formed thereon, as shown in FIG. 9. Cutting element samples were formed from each of the two prior art interface designs as well as the inventive interface shown in FIG. 2. The samples were formed having cutting layers with sharp cutting edges or with beveled cutting edges, as for example the cutting edges 50 and 52 shown in FIGS. 6 and 7, respectively. A five (5) Joule impact test was performed on the samples having a sharp edge 50 and a ten (10) Joule impact tests were performed on the samples having the beveled edge 52.

Three samples each having a cutting layer with the sharp cutting edge and the first prior art interface design were subjected to the five Joule impact test. Of the three samples, sample 1 had a 100% delamination of the cutting layer from the substrate after five impacts. Sample 2 had a 100% delamination of the cutting layer from the substrate after 25 impacts. Sample 3 had a small chip formed on the cutting layer after 25 impacts. Three samples each having a cutting layer with the sharp cutting edge and the second prior art interface design were subjected to the five Joule impact test. Sample 1 had 20% of the cutting layer chip and spall after three impacts. Sample 2 had 45% of the cutting layer chip or spall after 23 impacts. Sample 3 had 3% of the cutting layer chip after 25 impacts. Three samples of the inventive cutting element each having the substrate shown in FIG. 2 and the sharp cutting edges on its cutting layer were also subjected to the five Joule impact test. Sample 1 had a small chip on the cutting layer after 25 impacts. Sample 2 had a small chip on the cutting layer after 100 impacts. Sample 3 also had a small chip on the cutting layer after 100 impacts.

Three samples each having a cutting layer with the beveled cutting edge and the first prior art interface design were subjected to the ten Joule impact test. Sample 1 had no damage after 100 impacts. Sample 2 had no damage after 200 impacts. Sample 3 had 100% delamination of the cutting layer from the substrate after 300 impacts. Three samples each having a cutting layer with the beveled cutting edge and the second prior art interface design were subjected to the ten Joule impact test. Sample 1 had no damage after 100 impacts. Sample 2 had no damage after 200 impacts. Sample 3 had half of the cutting layer delaminated after 300 impacts. Three samples of the inventive cutting element each having the substrate shown in FIG. 2 and the beveled cutting edge on its cutting layer were also subjected to the ten Joule impact test. Sample 1 had no damage after 100 impacts. Sample 2 had no damage after 200 impacts. Sample 3 also had no damage after 300 impacts. As can be seen, all of the inventive cutting elements having the inventive interface performed better than the prior art cutting elements having the prior art interface during impact testing.

Additional advantages were seen by testing samples of cutting elements having the first and second prior art interfaces and the inventive interface shown in FIG. 2 for wear resistance using a lathe using a granite cylinder as a work piece as is common practice in the PCD industry. The normalized ratio of the amount of granite removed to the volume of the cutting element cutting layer removed is the quantitative measure of this test, with higher numbers indicating improved wear resistance and performance. The diamond material used in each sample was a multimodal powder distribution with an average nominal grain size of 12 microns. The wear resistance of two samples having the first prior art interface was determined to be 1.428 and 1.575, while the wear resistance of two samples of having the second prior art interface was determined to be 1.345 and 1.527. The wear resistance of two samples having the inventive interface was determined to 1.686 and 1.894, which was a 25% average improvement over the first prior art interface and a 19% average improvement over the second prior art interface. The wear test results indicate that the inventive interface imparts PCD sintering advantages over the prior art.

Also, samples having the first and second prior art interfaces and the inventive interface shown in FIG. 2 were tested for residual stresses using Raman spectroscopy. Diamond has a single Raman-active peak, which under stress free conditions is located at $\omega_0$=1332.5 $cm^{-1}$. For polycrystalline diamond, this peak is shifted with applied stress according to the relation:

$$\Delta\omega = \frac{\omega_0 \gamma}{B}\sigma_H$$

where $\Delta\omega$ is the shift in the Raman frequency, $\gamma$ is the Grunesian constant, equaling 1.06, B is the bulk modulus, equaling 442 GPa, and $\sigma_H$ is the hydrostatic stress. $\sigma_H$ is defined as:

$$\sigma_H = \frac{\sigma_1 + \sigma_2 + \sigma_3}{3}$$

where $\sigma_1$, $\sigma_2$, and $\sigma_3$ are the three orthogonal stresses in an arbitrary coordinate system, the sum of which equals the first stress invariant. In the center of the apex of an insert, it is reasonable to assume equibiaxial conditions $\sigma_1=\sigma_2=\sigma_B$ and $\sigma_3$=0). In which case, the relation between the biaxial stress $\sigma_B$ and the peak shift is given by:

$$\Delta\omega = \frac{2\omega_0\gamma}{3B}\sigma_B.$$

The equipment used to collect the Raman spectra employed a near-infrared laser operating at 785 nm, a fiber optic lens/collection system, and a spectrometer incorporating a CCD-array camera. The peak centers are determined by fitting a Gaussian curve to the experimental data using intrinsic fitting software. The Gaussian expression is given by:

$$I(x) = I_0\exp\left[\ln 0.5\frac{(x-\omega_C)^2}{(w/2)^2}\right]$$

where I(x) is the intensity as a function of position, $I_0$ is the maximum intensity, $\omega_C$ is the peak center, and w is the peak width, i.e., the full width at half maximum intensity. In this analysis, the fitted peak center was used to determine the residual stress. To facilitate accurate estimation of the residual stress, unsintered PCD powder was used to obtain the stress-free reference (1332.5 $cm^{-1}$).

To assess the comparative residual stresses, the laser probe described above was used to measure the stresses in nine locations along the top PCD surface of cutting elements having the first and second prior art interfaces, and the inventive interface. The measured residual compressive residual stresses were found to be:

| | |
|---|---|
| First Prior Art Interface: | 874 ± 80 MPa |
| Second Prior Art Interface: | 814 ± 49 MPa |
| Present Invention: | 766 ± 78 MPa |

Use of the interface of the present invention showed a 12% reduction in residual stress in comparison to use of the first prior art interface, and a 6% reduction in residual stress in comparison to use of the second prior art interface. The results clearly indicated that a substantial reduction in residual stresses was achieved with the use of the inventive interface. The benefit of reduction in residual stress as a general design principle has been well established. For example, PCD cutting elements having lower residual stresses as measured by Raman spectroscopy have proven to have improved overall field performance. Thus it is expected that the reduced residual stress seen with the inventive interface will prove likewise beneficial to performance.

Although the present invention has been described and illustrated with respect to multiple embodiments thereof, it is to be understood that the present invention should not be so limited, since changes and modifications may be made therein which are within the full intended scope of this invention as hereinafter claimed.

What is claimed is:

1. A cutting element comprising:

a substrate comprising a periphery and an interface surface; and an ultra hard material layer formed over the substrate and interfacing with said interface surface, wherein the interface surface comprises, a plurality of spaced apart projections formed inwardly and spaced apart from the periphery and arranged around an annular path, wherein each projection comprises a convex upper surface defining the projection, wherein each upper surface continuously and smoothly curves in the same direction increasing and then decreasing in height as viewed in cross-section along a plane through a diameter of the substrate, a first annular section extending to the periphery, a second section extending radially inward and above the first annular section, and a third annular section between the first annular section and the second section, wherein each of the plurality of spaced apart projections straddles the first annular section and the second section and extends across the first, second and third sections, wherein the second section extends to a height level, wherein each of said projections extends above said height level.

2. The cutting element as recited in claim 1 wherein each upper surface defines a parabola when viewed along the plane through a diameter of the substrate.

3. The cutting element as recited in claim 2 wherein each of the spaced apart projections is trapezoidal in plan view.

4. The cutting element as recited in claim 3 wherein each of the spaced apart projections is wider over the first section than over the second section.

5. The cutting element as recited in claim 4 wherein each of the spaced apart projections when viewed in plan view has a first end having a first width opposite a second end having a second width and a third section between the first and second ends having a third width, wherein the second width is narrower than the first width, and wherein the third width is not greater than the second width, and wherein the first end is formed over the first section and the second end is formed over the second section.

6. The cutting element as recited in claim 4 wherein said interface surface further comprises a first annular projection formed over said second section and formed radially inward from said spaced apart projections, wherein said first annular projection is spaced apart from said spaced apart projections.

7. The cutting element as recited in claim 6 wherein said interface surface further comprises a second annular projection over said second section and formed radially inward from said first annular projection, wherein said second annular projection is spaced apart from said first annular projection.

8. The cutting element as recited in claim 6 wherein said interface surface further comprises a central projection over said second section and formed radially inward from said first annular projection, wherein said central projection is spaced apart from said first annular projection.

9. The cutting element as recited in claim 6 wherein said first annular projection is polygonal in plan view.

10. The cutting element as recited in claim 1 wherein each of the spaced apart projections is trapezoidal in plan view.

11. The cutting element as recited in claim 10 wherein each of the spaced apart projections when viewed in plan view has a first end having a first width opposite a second end having a second width and a third section between the first and second ends having a third width, wherein the second width is narrower than the first width, and wherein the third width is not greater than the second width.

12. The cutting element as recited in claim 10 wherein each of said spaced apart projections has a width as measured along a second plane perpendicular to a central longitudinal axis of said substrate, wherein said width decreases as the distance of said second plane away from said interface surface increases in a direction toward said ultra hard material layer.

13. The cutting element as recited in claim 10 wherein said interface surface further comprises a first annular projection formed radially inward from said spaced apart projections, wherein said first annular projection is spaced apart from said spaced apart projections.

14. The cutting element as recited in claim 13 said interface surface further comprises a second annular projection formed radially inward from said first annular projection, wherein said second annular projection is spaced apart from said first annular projection.

15. The cutting element as recited in claim 13 said interface surface further comprises a central projection formed radially inward from said first annular projection, wherein said central projection is spaced apart from said first annular projection.

16. The cutting element as recited in claim 13 wherein said first annular projection is polygonal in plan view.

17. The cutting element as recited in claim 1 wherein each of the spaced apart projections widens in a radial direction toward the periphery.

18. The cutting element as recited in claim 1 wherein each wherein each upper surface defines a parabola when viewed along the plane through a diameter of the substrate.

19. A bit comprising:

a bit body; and a cutting element mounted on said bit body, said cutting element comprising, a substrate comprising a periphery and an interface surface, and an ultra hard material layer formed over the substrate and interfacing with said interface surface, wherein the interface surface comprises, a plurality of spaced apart projections formed inwardly and spaced apart from the periphery and arranged around an annular path, wherein each projection comprises a convex upper surface defining the projection, wherein each upper surface continuously and smoothly curves in the same direction increasing and then decreasing in height as viewed in cross-section along a plane through a diameter of the substrate, a first annular section extending to the periphery, a second section extending radially inward and above the first annular section, and a third annular section between the first annular section and the second section, wherein each of the plurality of spaced apart projections straddles the first annular section and the second section and extends across the first, second and third sections, wherein the second section extends to a height level, wherein each of said projections extends above said height level.

20. A cutting element comprising:

a substrate comprising a periphery and an interface surface; and an ultra hard material layer formed over the substrate and interfacing with said interface surface, wherein the interface surface comprises a plurality of spaced apart projections formed inwardly and spaced apart from the periphery and arranged around an annular path, wherein each projection comprises a convex upper surface defining the projection, wherein each upper surface continuously and smoothly curves in the same direction increasing and then decreasing in height as viewed in cross-section along a plane through a diameter of the substrate, wherein each of the spaced apart projections is trapezoidal in plan view, wherein each of the spaced apart projections when viewed in plan view has a first end having a first width opposite a second end having a second width and a third section between the first and second ends having a third width, wherein the second width is narrower than the first width, and wherein the third width is not greater than the second width.

21. The cutting element as recited in claim 20 wherein each of said spaced apart projections has a width as measured along a second plane perpendicular to a central longitudinal axis of said substrate, wherein said width decreases as the distance of said second plane away from said interface surface increases in a direction toward said ultra hard material layer.

22. A cutting element comprising:

a substrate comprising a periphery and an interface surface; and an ultra hard material layer formed over the substrate and interfacing with said interface surface, wherein the interface surface comprises a plurality of spaced apart projections formed inwardly and spaced apart from the periphery and arranged around an annular path, wherein each projection comprises a convex upper surface defining the projection, wherein each upper surface continuously and smoothly curves in the same direction increasing and then decreasing in height as viewed in cross-section along a plane through a diameter of the substrate, wherein each of the spaced apart projections is trapezoidal in plan view, and wherein said interface surface further comprises a first annular projection formed radially inward from said spaced apart projections, wherein said first annular projection is spaced apart from said spaced apart projections.

23. The cutting element as recited in claim 22 wherein said interface surface further comprises a second annular projection formed radially inward from said first annular projection, and wherein said second annular projection is spaced apart from said first annular projection.

24. The cutting element as recited in claim 22 wherein said interface surface further comprises a central projection formed radially inward from said first annular projection, and wherein said central projection is spaced apart from said first annular projection.

25. The cutting element as recited in claim 22 wherein said first annular projection is polygonal in plan view.

26. The cutting element as recited in claim 22 mounted on a bit body.

* * * * *

UNITED STATES PATENT AND TRADEMARK OFFICE

CERTIFICATE OF CORRECTION

PATENT NO. : 7,604,074 B2
APPLICATION NO. : 11/811671
DATED : October 20, 2009
INVENTOR(S) : Ron Eyre It is certified that error appears in the above-identified patent and that said Letters Patent is hereby corrected as shown below:

Column 9, Claim 18, line 24 Delete "wherein each"

Signed and Sealed this
First Day of February, 2011

David J. Kappos

David J. Kappos
*Director of the United States Patent and Trademark Office*